US006050538A

United States Patent [19]

Marrow et al.

[11] Patent Number: 6,050,538

[45] Date of Patent: Apr. 18, 2000

[54] RESTRAINT SYSTEM AND METHOD FOR PROTECTING BARRELS IN A BARREL STACK AGAINST EARTHQUAKE DAMAGE

[76] Inventors: Joshua M. Marrow, 792 30th Ave., San Francisco, Calif. 94121; Thor Ourston, 783 Arabian Cir., Arroyo Grande, Calif. 93420

[21] Appl. No.: 09/215,100

[22] Filed: Dec. 18, 1998

[51] Int. Cl.[7] ..... A47B 97/00; A47G 23/02

[52] U.S. Cl. ..... 248/505; 248/154; 248/500

[58] Field of Search ..... 248/146, 154, 248/500, 505; 108/53.1; 211/59.4, 85.18; 206/504, 391

[56] References Cited

U.S. PATENT DOCUMENTS

| | | | |
|---|---|---|---|
| 2,555,529 | 6/1951 | Batts | 410/35 |
| 3,019,916 | 2/1962 | Malcher | 206/596 |
| 4,175,666 | 11/1979 | Smith | 211/85.18 |
| 4,435,463 | 3/1984 | Roellchen | 428/158 |
| 4,901,870 | 2/1990 | Wright et al. | 211/59.4 |
| 5,161,703 | 11/1992 | Patton | 211/59.4 |
| 5,346,165 | 9/1994 | Frean et al. | 248/146 |
| 5,735,412 | 4/1998 | Sheckells | 211/59.4 |

OTHER PUBLICATIONS

Marrow, "Earthquake Risk In Wine Country," Vineyard & Winery Management, pp. 26–31, Nov./Dec. 1998.

Marrow, et al., "California Wine Industry Seismic Risk Analysis And Experimentation Project," California Polytechnic State University, pp. 1–14, Jan. 23, 1998.

Rieger, "Experts Share Barrel Room Management Tips At V&WM Seminar," Vineyard & Winery Management, pp. 16–17, Mar./Apr. 1998.

Marrow, "Wine Industry Earthquake Research,"—California Polytechnic University—San Luis Obispo Newsletter, 2 pages, Mar. 20, 1998.

Marrow, "Earthquake Safety," Vineyard & Winery Management, p. 29, Sep./Oct. 1998.

*Primary Examiner*—Ramon O. Ramirez
*Assistant Examiner*—David Heisey
*Attorney, Agent, or Firm*—Coudert Brothers

[57] ABSTRACT

A restraint system and a method is provided for protecting at least the top barrels in a barrel stack, having a plurality of modules, against earthquake damage. Each of the modules has a top rack, at least one intermediate rack and a bottom rack and at least one barrel on each of the racks. The barrel restraint system comprises restraining mechanism that is operably engaged to at least the top barrels in the module at the top of the barrel stack for restraining the top barrels within the top module. Typically each module contains at least two barrels and the restraining means restrains all of the top barrels. It has been discovered that by restraining all of the top barrels and only the top barrels within the top module, the top barrels will be protected from being ejected from the top rack. All of the remaining barrels in the intermediate and bottom racks may be protected without the use of the restraining means of this invention due to the overburden weight of the barrels stacked above.

5 Claims, 7 Drawing Sheets

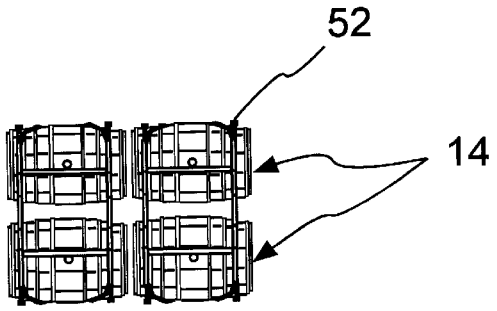
FIG.1A
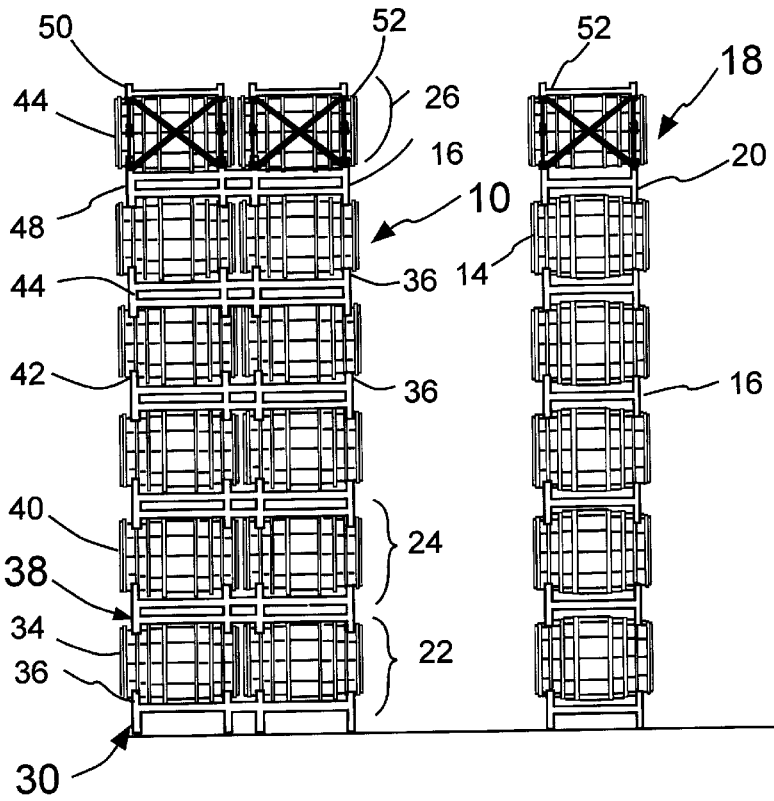
FIG.1
FIG.2
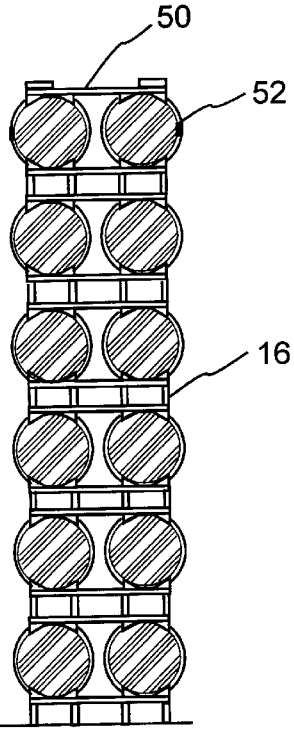
FIG.3

RESTRAINT SYSTEM AND METHOD FOR PROTECTING BARRELS IN A BARREL STACK AGAINST EARTHQUAKE DAMAGE

FIELD OF THE INVENTION

This invention relates to a restraint system and a method for protecting all of the barrels in a barrel stack against damage from earthquakes.

BACKGROUND OF THE INVENTION

Wooden barrels have been used for centuries to age and store liquor and wine. In fact at the present time, almost 50% of all wine produced is still being aged in 60 gallon oak barrels. Almost all of whiskey has been traditionally aged in smaller 50 gallon oak barrels.

The wine industry has grown, and presently more wine is aged in barrels than at any other time in history. There are estimates of close to ten times as many barrels used in the production of wine as there was in the late 1980's. Because wine is aged in barrels for upward of four years before it is ready to be bottled and consumed, there is a growing demand for oak wine barrels. To solve the problem of where and how to store all of the wine barrels, and to keep up with the growing demand, the portable steel barrel rack was developed in the late 1970's. Throughout the years as the barrel racks were adopted in the wine cellars, the racks evolved through a series of changes, shapes, and sizes ending with the modern rack most commonly used today. These modern racks enable the wineries to vertically stack one to six levels of a module (barrel rack with from two to four barrels placed on top) on a floor area of less than ten square feet. These barrel racks are designed to be easily moved and stacked with a fork lift truck. In addition, the racks accommodate easy barrel service, which includes racking the wine (removal of solids), topping off the barrels to replace evaporated liquids, and washing the barrels for future use.

As a direct result of the experience of some of the major wineries in California during two severe earthquakes of the mid and late 1980's, a growing number of wineries have developed concerns with the height they are stacking their barrels. Since the modules are independently stacked one on top of another, heights of more than 18 feet can be reached in a typical six module barrel stack; see FIGS. 1–3.

There are two reasons for this concern. One is personal safety for the many wine cellar workers who service the barrels each day. The other is the potential financial loss of the wine due to damaged and destroyed barrels. The typical wine barrel is made up of wooden staves shaped into a bulging cylinder contained by six to eight steel hoops spaced along the length of the barrel, a flat circular head at both ends, at least one bung hole generally on the belly, and the bung or cork. The barrels weigh from about 125 to 140 pounds empty and up to approximately 625 pounds full. A filled barrel of wine is valued at an average of $2200 based on an average price of $37 per gallon.

Although California wineries in the Santa Cruz Mountains, Monterey, and the south San Francisco Bay Area suffered great damage due to the 1984 Morgan Hill earthquake and the 1989 Loma Prieta 7.1 earthquake, it has only been within the past couple of years that an extensive investigation has been undertaken to learn if and how such damage could be alleviated.

A portion of the earthquake damage calculation was due to barrels stacks toppling which in turn caused the barrels to break and/or the bungs to pop loose allowing wine to leak on to the cellar floor. The damage the wineries experienced in these two past earthquakes is significantly less than what could be experienced in an earthquake today. This is true partly because of the greater number of oak barrels that are stored on these modern barrel racks stacked to heights of up to 18 feet. The wine industry was much smaller in the 1980's and the industry did not have a problem of limited storage space. Therefore the wineries had no need to be stacking the barrels at heights that could be considered unsafe. The investigation has shown that many of the wineries who were using the modern barrel rack system experienced barrel and wine losses due to wine barrels from the top-most module being ejected and thrown to the cellar floor. The investigation included interviews with personnel that were present in wine cellars during and after a severe earthquake to observe the affect the seismic shaking had on the barrel stacks. In addition, a study of the complex behavior of a barrel stack subjected to an earthquake was made possible by designing laboratory shake table tests described in the Example Section below.

In view of the foregoing, there is a need in the wine industry for a solution to the problem of protecting all of the barrels in a barrel stack of the type of module described above against damage from earthquakes.

SUMMARY OF THE INVENTION

The present invention is directed to a restraint system and a method for protecting primarily the top barrels in a barrel stack, having a plurality of modules, against earthquake damage. Each of the modules has a top rack, at least one intermediate rack and a bottom rack and at least one barrel on each of the racks. The barrel restraint system of the present invention comprises restraining means that is operably engaged to the top barrels in the module at the top of the barrel stack for restraining the top barrel within the top module. Typically each module contains at least two barrels and the restraining means restrains all of the top barrels. It has been discovered that by restraining all of the top barrels within the top module, all of the remaining barrels in the intermediate and bottom racks may be protected without the use of the restraining means of this invention. This theory will be investigated with future research and testing. In fact, there is some evidence to suggest that the top one or more barrels and only the top one or more barrels are to be restrained within the top module. Using the restraining means on all of the barrels in a stack could be counter productive.

Any restraining means may be used to restraint the top barrels within the top module which includes a strap, a rope, a cord, a web or similar material to engage a portion of each of the top barrels to the top rack so that each of the top barrels is restrained and is not free to substantially move in any direction. The remaining barrels in the stack are not restrained by such restraining means. As described in detail below, the preferred restraint system of the present invention comprises a pair of webs that engage each end of each top barrel and the top rack. The preferred restraint system also comprises a buckle mechanism in combination with each web to take up the slack in each web after the top barrel is restrained.

BRIEF DESCRIPTION OF THE DRAWINGS

FIG. 1 is a side view of a four barrel per module, six module barrel stack and the restraint system of a preferred embodiment of the present invention;

FIG. 1A is a top view of the top module of the barrel stack of FIG. 1 and the restraint system of a preferred embodiment of the present invention;

FIG. 2 is a side view of a two barrel per module, six module barrel stack and the restraint system of a preferred embodiment of the present invention;

FIG. 3 is an end view of the six module barrel stacks of FIGS. 1 and 2 and the restraint system of a preferred embodiment of the present invention;

DESCRIPTION OF THE PREFERRED EMBODIMENTS

Figure 4:
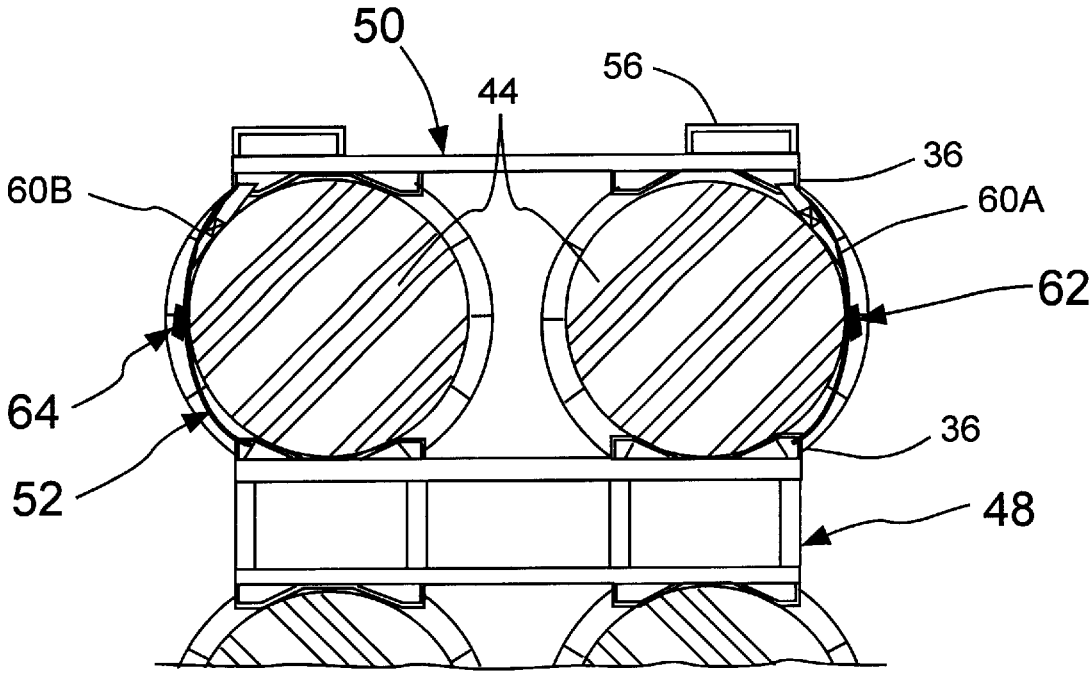
FIG. 4 is a detailed end view of the top module and the restraint system of a preferred embodiment of the present invention shown in FIG. 3.

Now referring to FIGS. 1 and 1A which are side and top views of six module barrel stack 10 containing four barrels 14 on each four barrel rack 16 for each module. FIGS. 2 and 3 are the side and end views of six module barrel stack 18 containing two barrels 14 on each two barrel rack 20. The barrel stack 10 consists of bottom module 22, intermediate modules 24 and top module 26. Preferably, bottom module 22 consists of bottom rack 30, also called a half rack because it is designed to cradle each of the bottom barrels 34 with a pair of saddles 36. Intermediate module 24 consists of intermediate rack 38, called a standard barrel rack. Intermediate module 24 is designed to cradle each of the intermediate barrels 40 between a pair of lower saddles 36 and a pair of upper saddles 42. Top module 26 preferably consists of top barrels 44 sandwiched between lower top rack 48, which is a standard rack, and upper top rack 50, which can be the same as bottom rack 30. Restraining mechanism 52 is used to restrain only top barrels 44 and is described in detail below.

Figure 5:
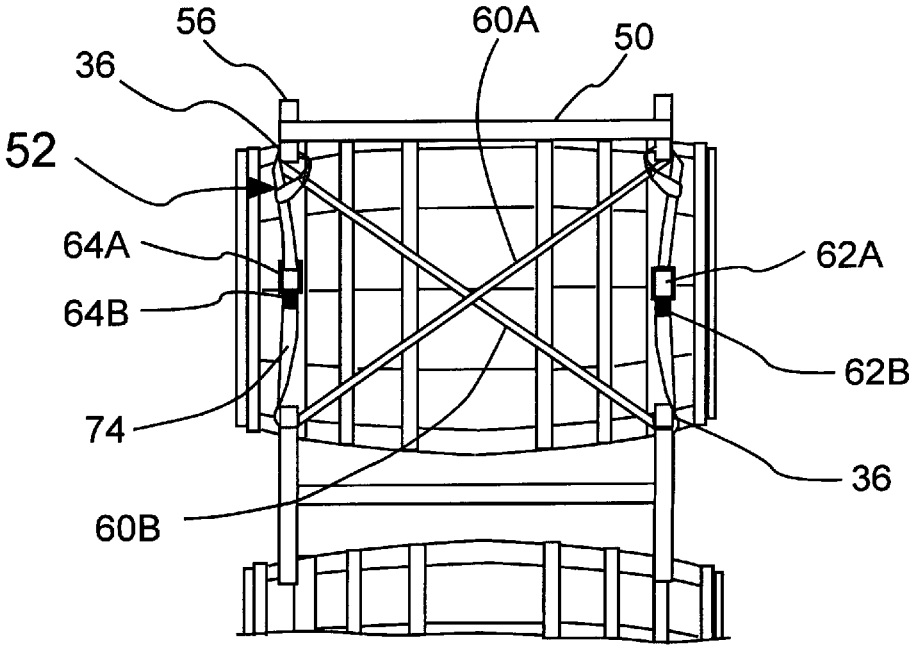
FIG. 5 is a detailed side view of the top module and the restraint system of a preferred embodiment of the present invention shown in FIG. 2.
Figure 6:
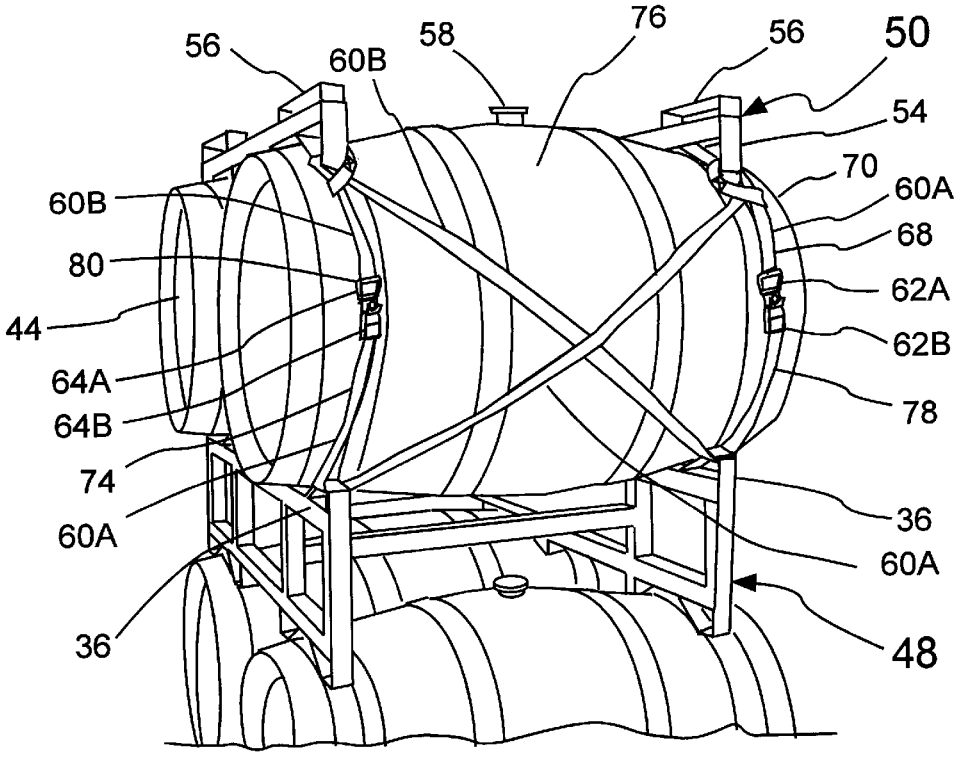
FIG. 6 is a prospective view of the top module and the restraint system of a preferred embodiment of the present invention shown in FIG. 2.
Figure 7A:
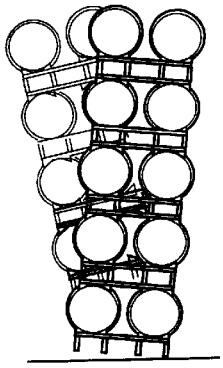
FIG. 7A is an end view of the transverse motion of a five module barrel stack under a first critical mode of seismic shaking without a restraint system.
Figure 7B:
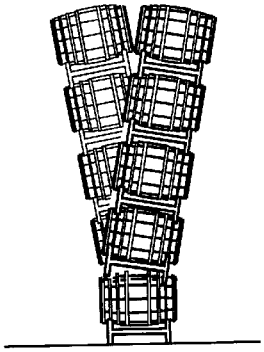
FIG. 7B is a side view of the coinciding longitudinal motion of the same five module barrel stack shown in FIG. 7B.
Figure 7C:
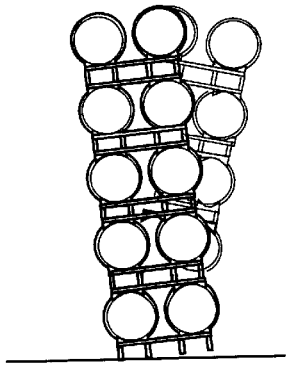
FIG. 7C is an end view of the transverse motion of a five module barrel stack under a second critical mode of seismic shaking without a restraint system.
Figure 7D:
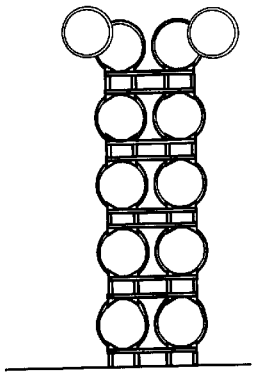
FIG. 7D is an end view of the transverse motion of a five module barrel stack under a third critical mode of seismic shaking without a restraint system.

FIGS. 4–6 show a preferred embodiment of the restraint system of the present invention consisting of restraining means or mechanism 52 for restraining each top barrels 44 between lower top rack 48 and upper top rack 50. Upper top rack 50 has two pairs of saddles 54 welded to the lower surface of its four corners to cradle the upper portion of top barrels 44. In the preferred embodiment of upper top rack 50, a pair of fork lift openings 56 are welded to the four corners of upper surface of upper top rack 50. Bung 58 is usually positioned in all barrels as shown in FIG. 6 so that it is easily accessible for servicing the barrels. Standard racks, half racks, lower top racks and the preferred upper top racks are manufactured by TOPCO Inc. of Grover Beach, Calif.

Figure 11A:
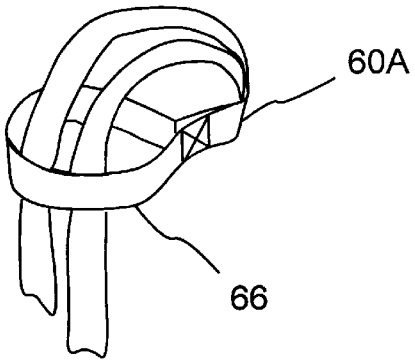
FIG. 11A detailed perspective view of a loop for use in connecting a web to a barrel saddle.
Figure 11B:
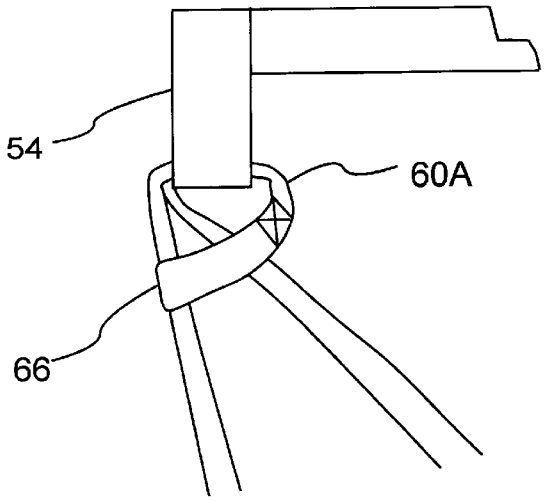
FIG. 11B is a detailed side view of the use of the loop shown in FIG. 11A in the process of connecting a web to a barrel saddle.

In the preferred embodiment shown in FIGS. 4–6, restraining mechanism 52 consists of a pair of webs or straps 60A and 60B and a pair of buckles 62 consisting of hook 62A and eye 62B and buckles 64 consisting of hook 64A and eye 64B for releasing and joining the respective ends of webs 60A and 60B after webs 60A and 60B have been engaged or otherwise secured a portion of top barrel 44. In this preferred embodiment, each of the pair of webs 60A and 60B have loops 66 sewn as shown in FIG. 11A or similarly fixedly attached near each end so that each loop 66 can be easily attached to a respective saddle. For example loop 66 adjacent end 68 containing hook 62A of web 60A is laid across saddle 54. End 68 with hook 62A is pushed through loop 66 as shown in FIG. 11A and web 60A is tightened against saddle 54 as shown in FIG. 11B and hook 62A is allowed to hang with a portion of web 60A encircling a portion of end 70 of top barrel 44. The remaining portion of web 60A is drawn diagonally down across belly 76 of top barrel 44 so that loop 66 adjacent end 74 can be looped through saddle 36. Web 60B is similarly positioned as shown in FIGS. 5 and 6 so hook 62A is joined to eye 62B adjacent end 78 and hook 64A adjacent end 80 can be releasing and joined to eye 64B adjacent end 74.

Figure 8:
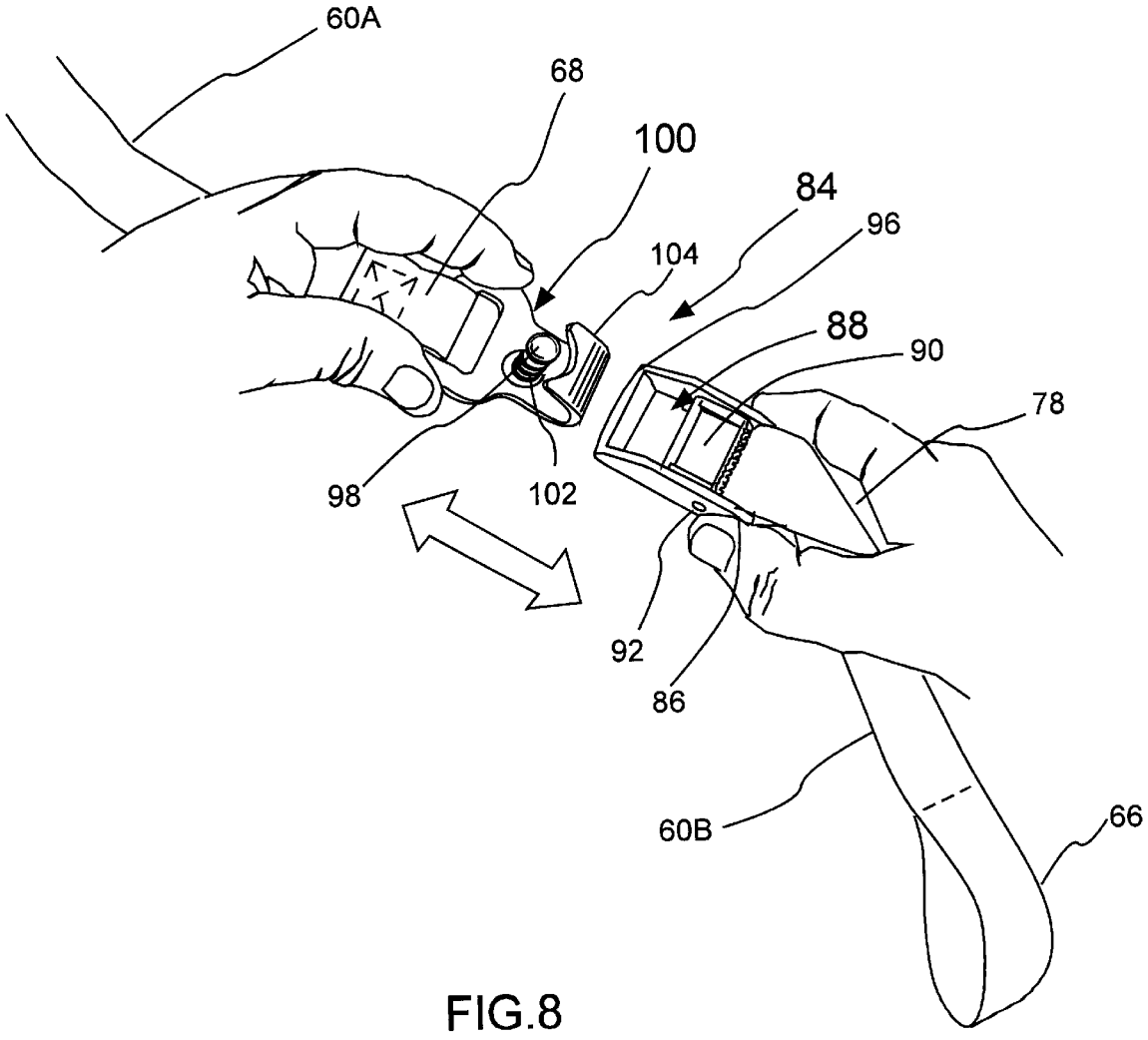
FIG. 8 is a prospective view of a preferred restraining mechanism being joined.

Although the buckle mechanism of the present invention can be any suitable buckle of the types used in belt buckles and safety belt buckles, one preferred embodiment of buckle mechanism 84 is shown in FIG. 8 in the process of being joined between end 68 of web 60A and end 78 of web 60B. End 78 is slipped through the lower end piece 86 of back bar 88 before stop cam lever 90 is sprung back in place to lock web 60B in place. Cam lever 90 is mounted axis bar 92 and is normally locked position by means of a spring (not shown) that encircles axis bar 92 with one end of the spring urged against the lower surface of cam lever 90. Upper end 96 of back bar 88 is urged against keeper 98 of hook 100 mounted on spring 102 to lodge in curved end 104. Hook 100 is sewn or similarly attached to end 68 of web 60A. The preferred buckle mechanism 84 shown in FIG. 8 is commercially available from a number of suppliers.

Figure 9:
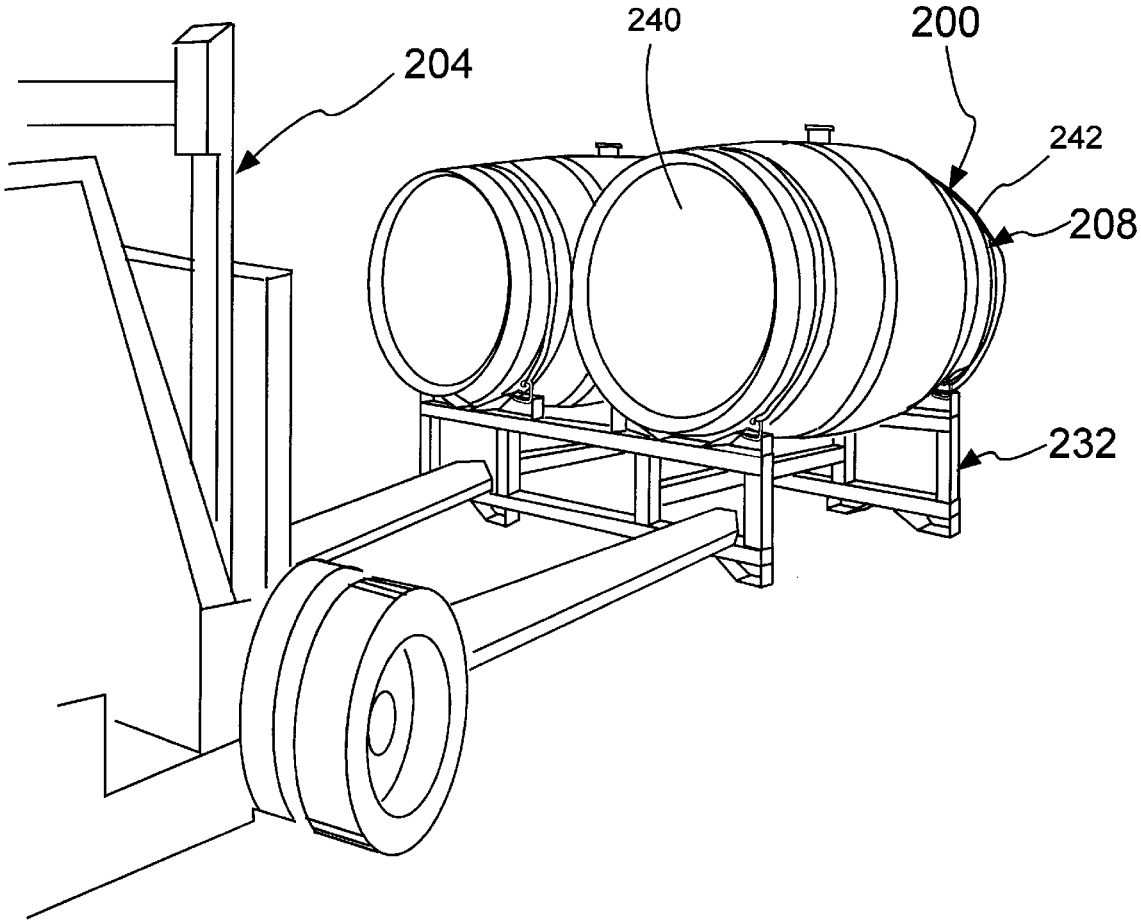
FIG. 9 is a prospective view of a top module of a two barrel module showing the step of the top module being lifted by a fork lift truck after one embodiment of the restraint system of the present invention is in place.
Figure 10:
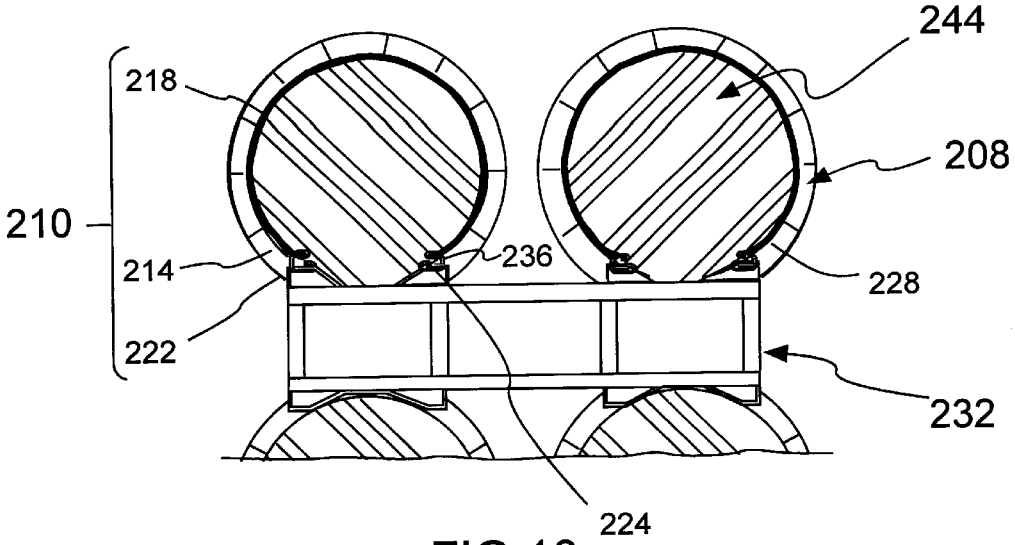
FIG. 10 is an end view of the top module shown in FIG. 9 after the step of lifting the module to the top of the two barrel per module stack.
Figure 10A:
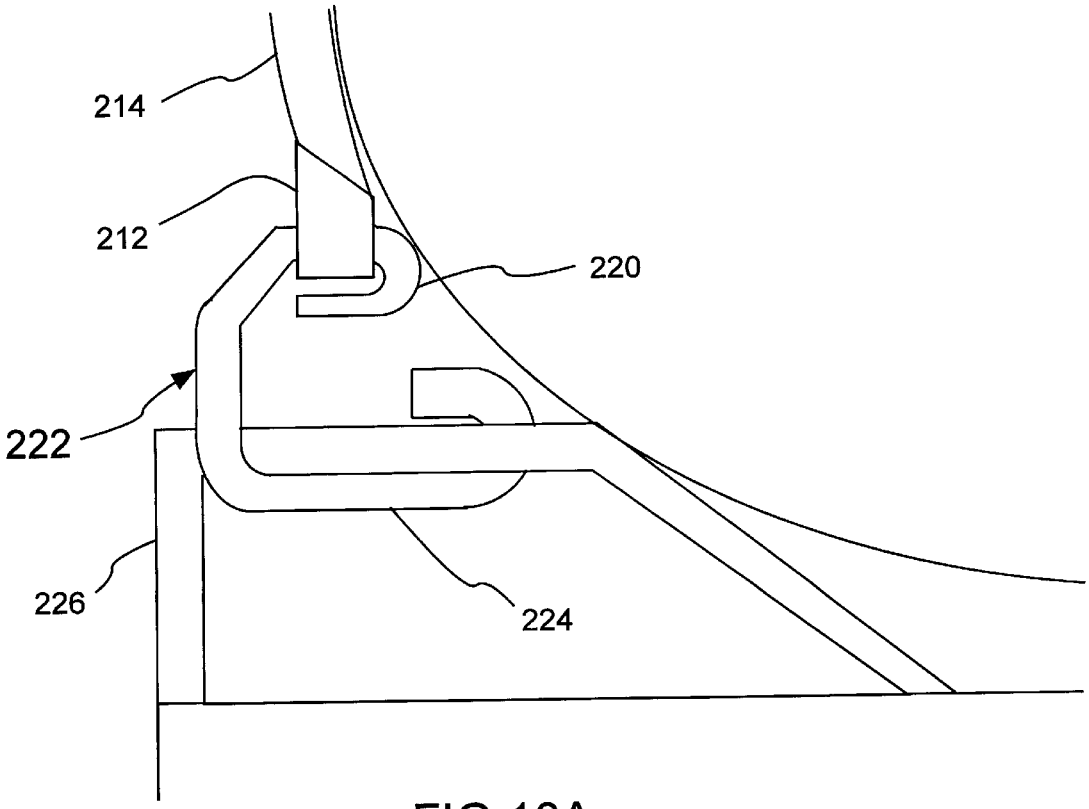
FIG. 10A is a detailed view of one embodiment of a restraint mechanism of the present invention attached to a barrel saddle of the top module shown FIG. 10.

FIGS. 9, 10, and 10A show another embodiment of the restraint system of the present invention. FIG. 9 shows top module 200 about to be lifted by fork lift truck 204 to the top of barrel stack 210 after restraining mechanism 208 has been tightened. Preferably the restraining mechanism of the present invention is originally engaged to each barrel while top module 200 is an the floor of the storage room, warehouse or other facility. After the restraining mechanism is attached to a saddle of a barrel rack, it may remain attached to the saddle as one barrel replaces another barrel during storage. In that case, the restraining mechanism is merely tightened around the barrel.

Figure 12A:
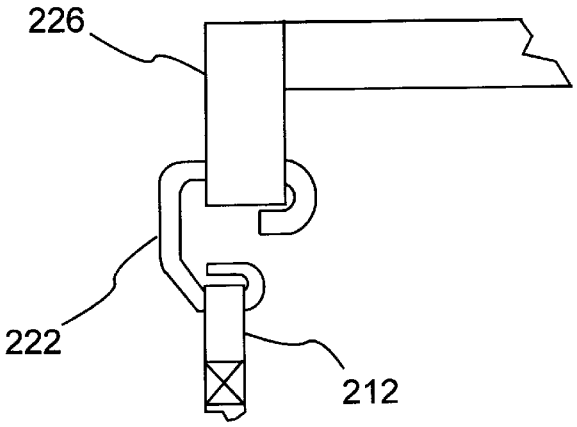
FIG. 12A is detailed side view of one embodiment of a restraint mechanism of the present invention connecting a web to a barrel saddle.
Figure 12B:
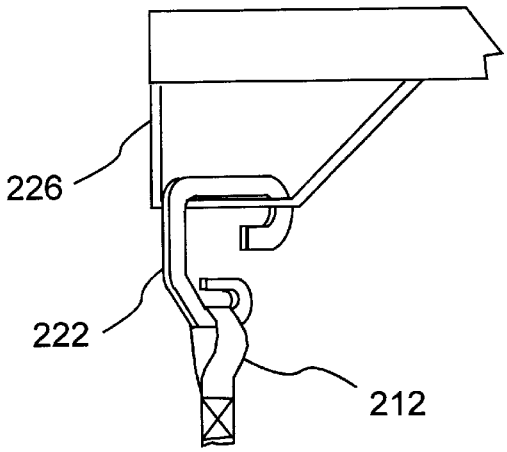
FIG. 12B is a detailed perspective view of one embodiment of a restraint mechanism of the present invention connecting a web to a barrel saddle.

In the embodiment of the restraint system shown in FIGS. 10, and 10A, loop 212 on end 214 of web 218 is looped around upper hook 220 of clip 222. Lower hook 224 of clip 222 is hooked over saddle 226 on upper rack 232. FIGS. 12A and 12B show detailed views of clip 222 connecting web 218 to barrel saddle 226. Similarly a loop (not shown) at the other end 228 of web 218 is looped around clip 236. In this embodiment, a buckle mechanism is not used. For example, a bungee cord having sufficient elasticity can be used to allow one to hook clip 222 over saddle 226 without the use of a buckle mechanism.

In the embodiment of the restraint system shown in FIGS. 9, 10, and 10A, first end 240 and second end 242 of top barrel 244 are restrained to top rack 232 by restraining mechanism 208 without the use of an upper top rack. Clip 222 also permits web 218 to be attached or tied to clip 222 with a simple clove hitch or similar knot without the use of loop 212.

EXAMPLES

The examples below summarize the conclusions reached after an 18 month investigation of the complex behavior of a barrel stack subjected to a simulated earthquake using a dynamic shake table.

Example 1

A prototype two barrel stack shown in FIGS. 7A–7D was used due to the limited laboratory surface area and the limitation on the payload capacity of the dynamic shake table. Each prototype barrel was fabricated to hold 5 gallons and to be roughly 50% of the full size of a French Bordeaux barrel having a length of 37.4 in. (37.4 cm.), an end diameter of 22 in. (56 cm.), a bilge diameter of 28 in. (71 cm.), and a stave thickness of 1.1 in. (27 mm.). The size of each of the prototype barrel racks was similarly reduced in scale to accommodate two prototype barrels. Each prototype rack was based on the dimensions of a full size 2-barrel, single crossbar rack having a seven inch fork lift opening. The prototype racks were constructed of ¾ in. 16-gauge square tube steel with ⅛ in. by ¾ in. bar stock for the saddles. The assembly was fabricated using the same conventional MIG welding process use to fabricate full sized racks. The finished prototype racks were powder coated using the same materials as full sized racks. A prototype barrel stack of six modules was about eight feet high.

The testing procedure was to test prototype barrel stacks of 3, 4, 5 and 6 modules high using the simulated restraint motion created by a shake table. The modules were tested with a one degree of freedom shake table using a time domain input in the form of varying frequencies of sinusoidal horizontal ground excitation while holding velocity or displacement amplitude constant throughout. Each of the 3–6 module high stacks was subjected to frequencies of 1–10 Hz increased at 0.1 Hz increments, a displacement of 1/16 in. (0.07 in.), and 20 second test duration.

The details of the laboratory study are found in a paper by Joshua M. Marrow, et al., California Wine Industry Restraint Risk Analysis and Experimentation Project, California Polytechnic State University, San Luis Obispo, Calif. The authors concluded there were three observed critical periods of motion. The first mode is illustrated in FIGS. 9A and 9B. The first mode was observed as a combined transverse (the direction of horizontal ground motion) and longitudinal (perpendicular to ground motion) rocking motion resulting in the barrel stack following a trace in the shape of an inverted cone. The second mode is illustrated in FIG. 9C. The second mode was observed as a transverse rocking motion in the direction of the ground excitation. The third mode is illustrated in FIG. 9D. The third mode was observed as a rocking and rotating motion of the top barrels within their respective top rack saddles. The third mode of response to a simulated restraint event resulted in the top barrels of the top module of a 4,5 and 6 module stack being ejected from the top rack. The laboratory evidence confirms reports from some wineries in the 1989 Loma Prieta and 1984 Morgan Hill quakes, that the top level barrels had been ejected from their associated top racks.

The top barrel ejection can also lead to what has been termed the peel-down effect. This can occur in a longer duration quake when the quake shacks each component of the module off the barrel stack one by one. The top barrels are first ejected, then the top rack, followed by each successive module below. Calculations indicate that even a minor earthquake with an epicenter within a reasonably close proximity of the winery could result in the collapse of the entire barrel stack as well as top barrel ejection.

To demonstrate the effectiveness of the restraint system of the present invention in protecting all of the barrels of a stack by restraining only the top barrels, the two top barrels of each of the 3–6 module barrel stack were equipped with the restraint device shown in FIG. 8. Specifically, buckle mechanism 84 consisted of the pair of webs 60A and 60B. Each web was 6 feet four inches long, 1 1/16 inch wide and 0.065 in. thick consisting of commercially availably woven polyester strapping. Loop 66 was 9 inches long and was formed by doubling back web 60B and sewing one end of web 60B onto itself as shown. A similar loop (not shown in FIG. 8) was formed by doubling back a portion of web 60A 10 ½ inches from end 106 and hook 100 . The same type of buckle mechanism 84 described above was used during the investigation. The above tests were repeated and the restraint system restrained only the top barrels and in turn protected all the barrels in the stack from damage.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of the invention be determined by the appended claims and their equivalents.

What is claimed is:

1. A method of protecting barrels in a barrel stack against earthquake damage comprising the steps of:

(a) forming a plurality of modules for stacking into the barrel stack, each module having a barrel rack and a plurality of barrels on said barrel rack;

(b) selecting the module that will form the top module of said barrel stack and providing a restraint system for only restraining each of the top barrels on said top module within said top module; and (c) stacking at least an intermediate module on a bottom module and ending with said top module, wherein each of the remaining barrels in said barrel stack is not restrained by said restraint system and said barrel stack is protected against earthquake damage.

2. The method of claim 1 wherein said top module comprises providing a plurality of top barrels of a top barrel rack, providing a second top barrel rack on the top barrels so that the top barrels are sandwiched between the two top barrel racks, and said barrel restraint system is provided for restraining said top barrels to said top barrel racks within said top module.

3. The method of claim 2 wherein said restraint system comprises a first web and a second web and buckle means operably attached to the first and second webs for releasing and joining said first and second webs and for taking up the slack in said web means after restraining said top barrel.

4. The method of claim 3 wherein each of the first and second webs of said restraint system of said top module is released from said buckle means for servicing said top barrels.

5. The method of claim 4 wherein said top module is removed from the barrel stack for servicing of said top barrels.

* * * * *